US005090407A

United States Patent [19]

Lesage et al.

[11] Patent Number: 5,090,407

[45] Date of Patent: Feb. 25, 1992

[54] CHEMICAL CARTRIDGE FOR PROTECTIVE RESPIRATORY MASK

[75] Inventors: Jacques Lesage, Repentigny; Claude Ostiguy, Chambly, both of Canada

[73] Assignee: I.S.S.T., Institute de Recherche en Sante et en Securite du Travail du Quebec, Canada

[21] Appl. No.: 569,562

[22] Filed: Aug. 20, 1990

[51] Int. Cl.[5] ..... A62B 7/10

[52] U.S. Cl. ..... 128/205.27; 128/205.28; 128/205.23

[58] Field of Search ..... 128/202.22, 205.28, 128/205.23, 205.27, 205.12; 55/DIG. 33, DIG. 35

[56] References Cited

U.S. PATENT DOCUMENTS

| | | | |
|---|---|---|---|
| 4,155,358 | 5/1979 | McAllister et al. | 128/146.6 |
| 4,326,514 | 4/1982 | Eian | 128/202.22 |
| 4,365,627 | 12/1982 | Wing | 128/202.22 |
| 4,428,907 | 1/1984 | Heijenga et al. | 128/202.22 |
| 4,488,547 | 12/1984 | Mason | 128/202.22 |
| 4,600,002 | 7/1986 | Maryyanek et al. | 128/206.19 |
| 4,643,182 | 2/1987 | Klein | 128/201.25 |
| 4,790,306 | 12/1988 | Braun et al. | 128/206.12 |
| 4,873,970 | 10/1989 | Freidank et al. | 128/202.22 |

OTHER PUBLICATIONS

"Protection of the Respiratory Organs and Skin of Diisocyante Workers", O. K. Ardasheva, V. I. Astrakhantseva, V. I. Tsivtsina, Institute of Industrial Hygiene and Occupational Diseases, Gor'kiy, pp. 92-95, 1964.

*Primary Examiner*—Edgar S. Burr
*Assistant Examiner*—Aaron J. Lewis
*Attorney, Agent, or Firm*—Darby & Darby

[57] ABSTRACT

A chemical cartridge for protective respiratory mask comprising a separate active filter section and main filter section. The active filter section is formed of an absorbent medium impregnated with a reagent capable to capture and derive a target toxic pollutant having a chemically active fuction into an inert, non-volatile and non-toxic matter as air is inhaled. This active filter section is permeable to other types of pollutant. The main filter section includes activated carbon, or any other equivalent filtering material, and is positioned downstream the active filter section. In operation, the target pollutant is captured and derived into inert, non-volatile and non-toxic matter by the active filter section, while the other types of pollutants pass through this active filter section and are captured by the main filter section.

7 Claims, 3 Drawing Sheets

CHEMICAL CARTRIDGE FOR PROTECTIVE RESPIRATORY MASK

BACKGROUND OF THE INVENTION

1. Field of the Invention

The present invention relates to a chemical air filtering device comprising an active filter section in series with a conventional and universal filter section. The active filter section comprises a reagent capable to capture a target toxic pollutant having a chemically active function and to derive it into inert, non volatile and non-toxic matter. The main filter section is positioned downstream the active filter section to capture other types of pollutants passing through the active section.

2. Brief description of the prior art

The conventional respiratory masks using a chemical cartridge are not safe enough against toxic pollutants having a chemically active function such as for example the isocyanates. The isocyanates mixed with other solvents are found in the paint shops, polyurethane foam factories, foundries, chemical plants, etc., and, as the workers are exposed, they can cause very serious respiratory illnesses such as acute poisoning, acute and chronic respiratory functional affections, professional asthma, etc. even at very low concentrations.

Masks supplied with fresh air efficiently protect the workers against the isocyanates and other toxic pollutants. However, in many instances it is, if not impossible, practically very difficult to use such masks. It is the case for example when the working area is exiguous, when the access to the working area is difficult, or when accumulations of aerosol on the visor of the mask cause visual problems. Also use of these masks is expensive.

In these environments, the workers often wear protective respiratory masks with a conventional chemical cartridge which generally lacks efficiency and safety against the toxic pollutants. The workers can therefore be exposed at least to small concentrations of toxic pollutant. Need has accordingly arisen for an efficient and safe alternative to the conventional chemical cartridges available on the market.

To that effect, the publication "PROTECTION OF THE RESPIRATORY ORGANS AND SKIN OF DIISOCYANATE WORKERS" by 0. K. Ardasheva, V. I. Astrakhantseva and V.I. Tsivtsina, INSTITUTE OF INDUSTRIAL HYGIENE AND OCCUPATIONAL DISEASES, Gor'kiy pp. 92–95, 1964, suggests a protective respiratory cartridge comprising a layer of activated carbon and a layer of absorbent B in the ratio 1:4.5. The activated carbon is placed upstream the absorbent B which is therefore the layer closest to the user. This cartridge was tested with diisocyanates as the target pollutants. As the absorbent B is not capable of deriving the diisocyanates into inert, non volatile and non toxic matter, the pollutant can migrate through the absorbent and can therefore be inhaled by the user. The pollutant also migrates when the mask is unused and can of course be inhaled when the mask is subsequently worn.

Regarding U.S. Pat. No. 4,643,182 (Klein) issued on Feb. 17, 1987, it proposes a protective respiratory mask using activated carbon to capture pollutants present in the inhaled air. The activated carbon itself contains a chemical substance capable of deriving a target toxic pollutant into inert matter. The chemical substance removes from the air the toxic pollutant while the activated carbon captures the other types of pollutants. A drawback of the mask of Klein is that the volume of the mask comprises regions with a lower concentration of chemical substance which allow passage of toxic pollutant. Also toxic pollutant captured in the activated carbon migrates through the mask when the same is unused. The so captured toxic matter can of course be inhaled when the mask is subsequently worn.

OBJECTS OF THE INVENTION

An object of the present invention is therefore to provide a safe alternative to the prior art chemical cartridges for adequately protecting the workers against toxic pollutants having a chemically active function.

Another object of the present invention is a chemical cartridge for protective respiratory mask capable of capturing and deriving a target toxic pollutant into a non-toxic and non-volatile inert matter without reducing the efficiency of the cartridge in capturing the other types of pollutants, whereby air contaminated with the target pollutant and passing through such a chemical cartridge can be inhaled without risk.

SUMMARY OF THE INVENTION

More generally, the subject invention relates to a chemical device for filtering air contaminated by a target toxic pollutant having a chemically active function, comprising separate active filter section and universal filter section. The active filter section includes a chemical reagent capable to capture the target pollutant and derive this pollutant into an inert, non volatile and non toxic matter as the contaminated air passes through this active filter section and the universal filter section is positioned downstream the active filter section and is capable to capture these other types of pollutants. In operation, the target pollutant is captured and derived into inert, non volatile and non toxic matter by the active filter section, while the other types of pollutants pass through the active filter section and are captured by the universal filter section.

The chemical device can further comprise an indicator positioned between the active and universal filter sections to indicate passage of the target pollutant through the active filter section.

In accordance with other preferred embodiments of the present invention, the active filter section comprises an absorbent medium impregnated with the chemical reagent, and the main filter section comprises activated carbon. Advantageously, the chemical filtering device also comprises means for enabling replacement of the active filter section.

In the present disclosure and in the appended claims, the term "pollutant" is intended to designate any toxic pollutant having a chemically active function, and the term "reagent" any reagent capable to capture and derive such a pollutant into inert, non volatile and non toxic matter.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

In the following description, the present invention is applied to a protective respiratory mask. It should however be kept in mind that it is not limited to this particular application. Indeed, the invention can be used for the general purpose of filtering air contaminated by a given toxic pollutant, that is the target pollutant.

Also, although the following description mentions for example the isocyanates as the target pollutant, the present invention also applies to other types of toxic pollutants having a chemically active function such as to give some examples the aldehydes, ketones, ozone, alcohols, amines, amides, ammonia, epoxy resins, etc. Obviously, the chemical reagent is selected in function of the target pollutant; the reagent should be capable to capture and derive the pollutant into inert, non volatile and non toxic matter.

Figure 1:
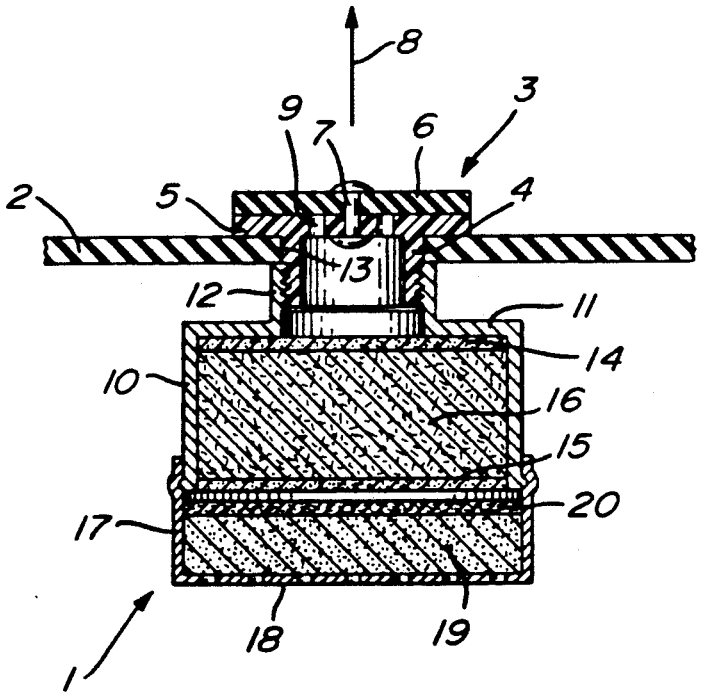
FIG. 1 is a schematic, cross sectional view of a chemical filtering device in accordance with the present invention, namely a chemical cartridge which can be installed on a conventional protective respiratory mask.

A chemical cartridge in accordance with the present invention, generally identified by the reference numeral 1, is illustrated in FIG. 1.

Although it forms no part of the present invention, it is believed to be appropriate to briefly describe in the following five paragraphs an example for the environment of the chemical cartridge of the present invention.

As illustrated in FIG. 1, the chemical cartridge is installed on a conventional protective respiratory mask 2 partially shown and made for example of rubber material. In fact, the cartridge 1 can be installed on different types of protective respiratory masks presently available on the market.

FIG. 1 depicts a respiratory valve 3 including an externally threaded tubular section 4, and a perforated disk section 5 secured at one end of the tubular section. The disk section 5 is perpendicular to the tubular one. The valve 3 further comprises a circular and flexible rubber flap 6 attached to the disk section 5 through a central fastener 7 coaxial with the tubular section 4.

In operation, when air is inhaled by the user as indicated by the arrow 8, the flap 6 moves away from the disk section 5 to allow the inhaled air to pass through the perforations such as 9 of the latter section. When air is exhaled, the flap 6 comes into contact with the disk section 5 to prevent the exhaled air to penetrate the cartridge I through the perforations 9; migration of the pollutants captured in the cartridge 1 is thereby prevented to maintain the efficiency and safety of the chemical cartridge. The exhaled air is evacuated through another valve (not shown) of the mask 2.

The structure and operation of this type of respiratory valve is well known in the art and accordingly will not be further elaborated.

In order to install the cartridge 1 on the mask 2, the tubular section 4 is first inserted in a hole 13 made in the rubber material with the disk section 5 and the flap 6 inside the mask. An internally threaded tubular section 12 is then screwed on the tubular section 4 until the rubber material of the mask 2 is squeezed between the disk section 5 and the free end of the tubular section 12 to thereby form a sealed joint.

The chemical cartridge 1 comprises, as illustrated in FIG. 1, a first hollow and cylindrical body 10 advantageously manufactured with metal or molded plastic material in accordance with conventional techniques. The body 10 is formed at one end with an annular wall 11 perpendicular to the axis of the body 10. Connected to the wall 11 is the central, internally threaded tubular section 12. As can be seen, the section 12 is coaxial to the body 10, and has a diameter smaller than that of the latter body.

A layer 14 of glass wool is placed inside the body 10 against the annular wall 11. The open end of the body 10 is closed by means of another layer 15 of glass wool and the space in the body 10 between the layers 14 and 15 is filled with activated carbon. A material other than glass wool can obviously be used in the manufacture of the layers 14 and 15. It is also within the scope of the present invention to replace the activated carbon by another equivalent filtering material. If desired, a perforated cover (not shown), made of plastic material or of sheet metal can be placed over the layer 15 of glass wool.

The cartridge I further comprises a second hollow and cylindrical body 17 preferably formed with a perforated cover 18. The body 17 is advantageously made of plastic material whereby the cover 18 can be molded integral therewith.

In the body 17 is placed an absorbent medium 19 made for example of glass wool. The medium 19 has preferably a thickness of about 1–2 cm and is impregnated with an active reagent. The open end of the body 17 is closed by a color changing indicator 20.

As shown in FIG. 1, the free end of the body 10 is externally embossed while the corresponding end of the body 17 is internally grooved so that the body 17 can be snapped onto the body 10. The diameters of these two bodies are obviously selected for that purpose. This enables easy removal of the body 17 to check whether the indicator 20 has changed color.

In operation, air contaminated with the target pollutant is inhaled by the user and passes through the perforations in the cover 18, the impregnated medium 19, the color changing indicator 20, the layer 15, the activated carbon 16, the layer !4, and finally the respiratory valve 3.

The absorbent medium 19 is impregnated with a reagent capable to capture and derive the target pollutant contaminating the inhaled air into an inert, non-toxic and non-volatile matter through a chemical reaction. Accordingly, the medium 19 constitutes an active filter section designed to selectively derive the target, toxic pollutant. This active filter section can be impregnated through immersion of the absorbent medium 19 into a solution containing the reagent and a solvent, and through subsequent drying of the so immersed medium. It should be pointed out here that impregnation of the medium 19 with reagent must not increase the resistance of the cartridge 1 to respiration. Obviously, the reagent of which the medium 19 is impregnated is selected in function of the pollutant to derive. Different reagents can eventually be used provided that they are capable to derive the pollutant of concern efficiently in the conditions of temperature and humidity encountered. As the medium 19 is impregnated with reagent, over its entire volume, all the pollutant passing through the active filter section should come into contact with the reagent, and is therefore captured by the reagent and derived into inert matter.

When the active filter section (impregnated medium 19) reaches break-through, pollutant passes through this filter section to reach the indicator 20 which changes color. The indicator 20 is a sheet of fibrous and porous paper impregnated with a chemical substance reacting with the pollutant to develop a color. It is believed to be within the skill of an expert in the art to select the appropriate chemical substance in function of the target pollutant. When the indicator 20 changes color, the hollow body 17 along with the indicator 20 and impregnated medium 19 are removed from the body 10 and replaced by another fresh active filter section (body 17, medium 19 and indicator 20). As can be appreciated, the indicator 20 greatly improves the safety of the workers exposed to odorless pollutants.

The activated carbon 16 constitutes a main filter section which captures the other types of pollutants present in the inhaled, contaminated air, and passing through the active filter section. The efficiency of activated carbon for that purpose is well known in the art.

Accordingly, as the pollutants captured by the main filter section pass through the active filter section, they do not contribute in saturating the latter filter section and, therefore, in reducing its lifetime and its efficiency in capturing and deriving the target pollutant.

As can be appreciated from the foregoing description, the active filter section is formed of absorbent medium evenly impregnated with reagent and is separate and independent from the main filter section (activated carbon 16) to enable selective and very efficient derivation of the target, toxic pollutant into inert matter while allowing the main filter section to capture without reduction in efficiency the other pollutants in suspension in the inhaled air. The so filtered air can therefore be inhaled without risk.

Figure 2:
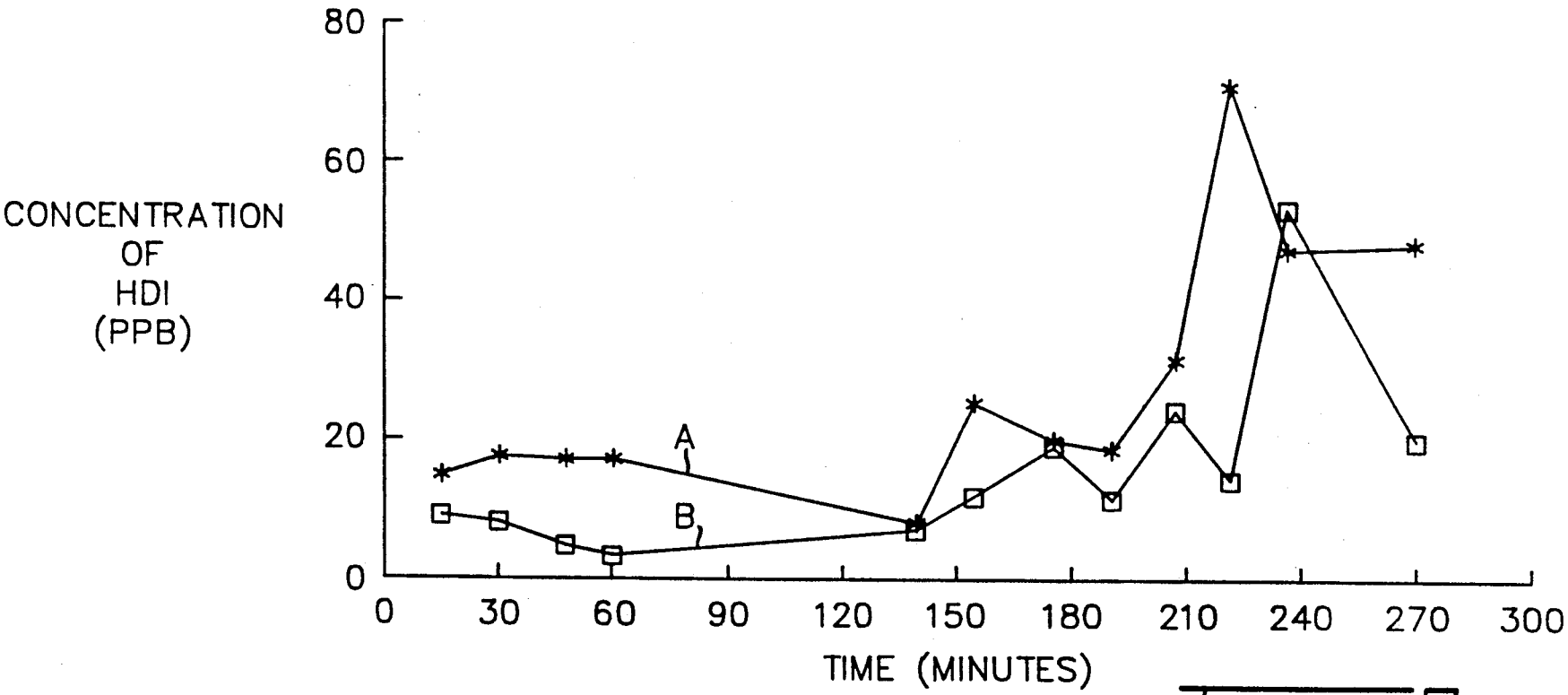
FIG. 2 is a graph showing the concentration of target pollutant in the air upstream and downstream the chemical cartridge when the active filter section is not impregnated with reagent.

In the example of FIG. 2, a solution containing hexamethylene diisocyanate (HDI) dispersed in toluene is vaporized and diluted in air, and used as target pollutant. The flow rate of the so contaminated air is 15 liters/minute which corresponds to respiration of a relaxed human. The concentration of the pollutant in the air i-s. of the order of 18–20 PPB and the active filter section is not impregnated with reagent. The graph of FIG. 2 shows that the concentration of HDI upstream (curve A) the cartridge 1 follows that downstream (curve B) the cartridge 1.

Figure 3:
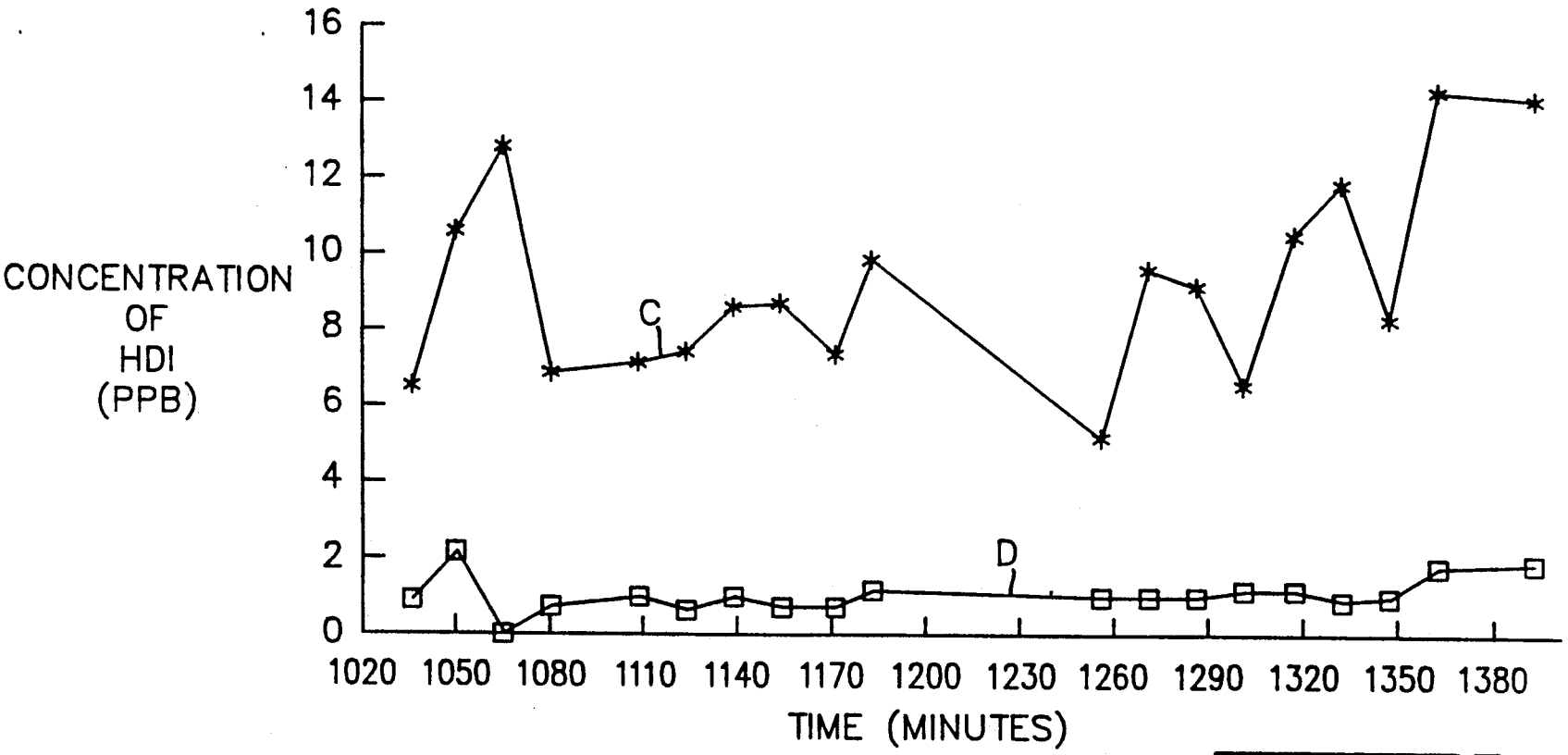
FIG. 3 is a graph showing the concentration of target pollutant in the air upstream and downstream the chemical cartridge when the active filter section is impregnated with reagent.

In the example of FIG. 3 a solution containing HDI dispersed in toluene is vaporized and diluted in air, and the so produced contaminated air is passed through the cartridge 1. The flow rate is again of about 15 liters/minute and the concentration of pollutant in the air is of the order of 6–14 PPB as evidenced in the graph of FIG. 3. The active filter section is formed of a medium 19 of glass wool 1–2 cm thick and impregnated with 26 mg of methyl-amino-methyl anthracene (MAMA). In the graph of FIG. 3, the curve C represents the concentration of HDI upstream the cartridge 1, and the curve D the concentration of HDI downstream the same cartridge. The graph of FIG. 3 therefore demonstrates that most of the HDI is captured and derived by the active filter section. In this particular example, break-through is not reached yet after 23 hours of operation.

The graphs of FIGS. 2 and 3 accordingly demonstrate the high efficiency of an impregnated, glass wool active filter section in capturing and deriving a target, toxic pollutant into inert, non-toxic and non-volatile matter. By changing the concentration of the reagent, the efficiency of the active filter section can eventually be improved.

Although the present invention has been described in detail hereinabove with reference to a preferred embodiment thereof, such an embodiment can be modified at will, within the scope of the appended claims, without departing from the spirit and nature of the invention. As an example, the present invention encompasses the use of reagents other than MAMA to derive HDI or other types of very toxic pollutant. Also, when the inhaled air is contaminated with a plurality target pollutants, the active filter section can be impregnated with one or many chemical reagents capable to capture and derive all the target pollutants.

We claim:

1. A chemical device for filtering air contaminated by a target pollutant having a chemically active function and pollutants other than the target pollutant, comprising a separate active filter section and a main filter section;

said active filter section including a chemical reagent capable of capturing the target pollutant and reacting with it to convert said target pollutant into an inert, non-volatile and non-toxic matter as said contaminated air passes through said active filter section;

said active filter section being permeable to said pollutants other than the target pollutant; and said main filter section being positioned downstream said active filter section and being capable capturing said pollutants other than the target pollutant;

whereby the target pollutant is captured and derived into said inert, non-volatile and non-toxic matter by said active filter section, while said pollutant other than the target pollutant pass through said active filter section and are captured by said main filter section the chemical device further including means for enabling replacement of said active filter section, said means including a first hollow body containing said universal filter section, a second hollow body containing said active filter section, the replacement enabling means comprising means for removably mounting the second hollow body onto said first body, and said removably mounting means comprising means for snapping said second hollow body onto said first body.

2. A chemical device as recited in claim 1, further comprising an indicator being capable to indicate passage of the target pollutant through the said active filter section.

3. A chemical device as recited in claim 2, wherein the said indicator is positioned between the active filter section and the main filter section.

4. A chemical device as recited in claim 1, wherein the said active filter section comprises an absorbent medium impregnated with said reagent.

5. A chemical device as recited in claim 4, in which said absorbent medium comprises glass wool.

6. A chemical device as recited in claim 1, in which main filter section comprises activated carbon.

7. A chemical device as recited in claim 1, wherein said target pollutant is a combination of many toxic substances and wherein said active filter section includes a plurality of chemical reagents being capable to capture the toxic substances and to derive said substances into inert, non volatile and non toxic matters.

* * * * *